US008684782B2

(12) United States Patent
Fiore

(10) Patent No.: US 8,684,782 B2
(45) Date of Patent: Apr. 1, 2014

(54) CONVERTIBLE FLOWER DOLL

(75) Inventor: Jeanette Marie Fiore, Hartselle, AL (US)

(73) Assignee: Fiore Enterprises LLC, Hartselle, AL (US)

( * ) Notice: Subject to any disclaimer, the term of this patent is extended or adjusted under 35 U.S.C. 154(b) by 14 days.

(21) Appl. No.: 13/105,357

(22) Filed: May 11, 2011

(65) Prior Publication Data

US 2012/0289121 A1 Nov. 15, 2012

(51) Int. Cl.
*A63H 3/02* (2006.01)

(52) U.S. Cl.
CPC ..... *A63H 3/02* (2013.01)
USPC ..... 446/72; 446/73; 446/268; 446/369; 446/372

(58) Field of Classification Search
CPC ..... A63H 3/02
USPC ..... 446/72, 73, 268, 369, 372
See application file for complete search history.

(56) References Cited

U.S. PATENT DOCUMENTS

| | | | | | |
|---|---|---|---|---|---|
| 226,922 | A | * | 4/1880 | Moses | 220/212 |
| 769,935 | A | * | 9/1904 | Brom | 446/359 |
| 1,396,766 | A | * | 11/1921 | McClelland | 446/321 |
| 1,407,165 | A | * | 2/1922 | Hamilton | 446/74 |
| D62,808 | S | | 7/1923 | Wood | |
| D65,838 | S | | 10/1924 | Stevens | |
| 1,583,284 | A | | 5/1926 | Dykman | |
| 1,640,260 | A | * | 8/1927 | Vogel | 446/268 |
| D74,720 | S | | 3/1928 | Cormany | |
| 1,778,670 | A | * | 10/1930 | Herbison | 446/370 |
| 1,966,986 | A | * | 7/1934 | Martin | 446/321 |
| 3,471,964 | A | * | 10/1969 | Cherry et al. | 446/268 |
| 3,597,877 | A | * | 8/1971 | Speers | 446/72 |
| 3,851,419 | A | * | 12/1974 | Kaelin | 446/321 |
| 4,107,873 | A | * | 8/1978 | Bauer | 446/321 |
| 4,795,398 | A | * | 1/1989 | Wexler | 446/327 |
| 4,842,565 | A | * | 6/1989 | VonPhilp, Sr. | 446/321 |
| 5,149,289 | A | * | 9/1992 | Edwards et al. | 446/321 |
| 5,194,030 | A | * | 3/1993 | LeBoeuf et al. | 446/72 |
| 5,224,894 | A | * | 7/1993 | Nelson et al. | 446/73 |
| 5,310,378 | A | * | 5/1994 | Shannon | 446/268 |
| 5,503,583 | A | | 4/1996 | Hippely et al. | |
| 5,522,758 | A | * | 6/1996 | Liu et al. | 446/310 |
| 8,133,090 | B2 | * | 3/2012 | Hardin | 446/331 |
| 2010/0093254 | A1 | * | 4/2010 | Jung | 446/376 |
| 2012/0003899 | A1 | * | 1/2012 | Wallace | 446/268 |

FOREIGN PATENT DOCUMENTS

| | | | |
|---|---|---|---|
| WO | 93/03807 | A1 | 3/1993 |
| WO | 2010/129224 | A2 | 11/2010 |

OTHER PUBLICATIONS

European Patent Office, International Search Report and Written Opinion of the International Searching Authority, International Application No. PCT/US2012/036865 (11 pages).

* cited by examiner

*Primary Examiner* — Gene Kim
*Assistant Examiner* — Alexander Niconovich
(74) *Attorney, Agent, or Firm* — Wood, Herron & Evans, LLP

(57) ABSTRACT

A convertible flower doll has garment including a skirt with layers that may be raised or lowered to convert the doll between a figure resembling a flower and a figure resembling a character. In flower form, the doll sits within a container resembling a flower pot. The doll has legs that wrap together and attach at the ankles to resemble a flower stem. The skirt has features resembling flower petals, and elastic in the lowest layer of the skirt bunches up the skirt layers when raised to resemble a flower.

14 Claims, 8 Drawing Sheets

CONVERTIBLE FLOWER DOLL

FIELD OF THE INVENTION

The present invention relates generally to children's toys and, more particularly, to convertible flower dolls.

BACKGROUND OF THE INVENTION

The doll, which may be designed as a miniature representation of a person or animal, is a basic staple of children's toys. Representations of real and fictional characters have been popular especially among girls for many years, and dolls continue to be a common plaything and socialization tool for children.

Convertible dolls, wherein a single toy can be transformed from one likeness to another, have been in use for more than a century. The basic convertible doll design uses two upper torsos attached at the middle with a reversible skirt, and is often termed a topsy-turvy doll. The upper torso is visible, while the lower torso is concealed by the skirt of the doll.

More recent convertible dolls include pop-up dolls, where the upper body of the doll is first concealed by a container which then later acts in substitution of the doll's absent lower half. Additionally, advancements to the topsy-turvy doll include the addition of removable sheaths to better conceal the unused lower torso, as well as the substitution of other objects for one of the two figures. Still, neither topsy-turvy dolls nor pop-up dolls include a full body doll.

Smaller full-body dolls have also been enclosed completely or primarily within simulated flower blossoms. In these dolls, the flower blossoms are presented as furniture or housing for the dolls rather than part of the doll, and do not really form a convertible toy as understood in the art. Although they provide some amount of joy in the surprise of the user, these toys do not allow the user to interact with the flower and girl as two forms of the same toy.

The conventional convertible doll is limited by having only a portion of the doll's anatomy. A need exists for a convertible full-body doll that, at least when in the form of a person, represents both the upper and lower body of the person. A need also exists for a convertible doll that conveniently and convincingly transforms into a flower.

SUMMARY OF THE INVENTION

In one embodiment, a convertible flower doll includes a body having both an upper and a lower body and a reversible skirt that can be raised and lowered such that the skirt resembles part of a garment in the lowered position and part of a flower in the upper position. The skirt in the upper position conceals the upper body of the doll, but the upper body of the doll is visible when the skirt is in the lowered position.

The skirt may have features resembling flower petals that are visible as part of the flower when the skirt is in the raised position and visible as part of the garment when the skirt is in the lower position. The doll may also have a structural element positioned to enclose the skirt to maintain the shape of the flower when the skirt is in the raised position; the element may be a sheath positioned to conceal the lower body of the doll and resemble a part of the flower when the skirt is in the upper position, and then be removed to uncover the doll's lower body when the skirt is in the lowered position.

The skirt may be elastic and may maintain the shape of the flower when the skirt is in the raised position. The skirt may have both an upper and a lower layer, the lower layer surrounding the upper layer to maintain the shape of the flower when the skirt is in the raised position.

The lower body may include legs that can be positioned to resemble a flower stem when the skirt is in the raised position. It may be possible to attach the legs together and twist them to resemble a flower stem or roots.

In another embodiment, a convertible flower toy includes a doll with an upper body and legs, a garment sized to fit the doll that includes a reversible skirt configured to lift upward to conceal the doll's upper body and resemble a flower, and a container with an opening sized to receive the lower body of the doll when the reversible skirt is positioned to resemble a flower. The toy may be shaped and colored to resemble a planted flower when the reversible skirt is positioned to resemble a flower and the lower body of the doll is within the container. The container may resemble a flower pot and may also include a surface adjacent to the opening that is sized and colored to resemble a planting medium for a flower.

The toy may also include a second doll-sized that has a reversible skirt configured to lift upward and conceal the doll's upper body. The second garment may resemble a different type of flower from the first garment.

The container may further include a body, an insert placed within the body that includes the recess, and a cup removably placed around the outside of the body. The cup may be suitable to hold drinking liquid when removed from around the body.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Referring to the figures, FIGS. 1-5 illustrate one embodiment of a convertible flower doll 2 in accordance with the principles of the present invention, showing the transition of the toy from a flower planted in a pot to a doll with a flower-themed garment, shown as a dress 4.

Figure 1:
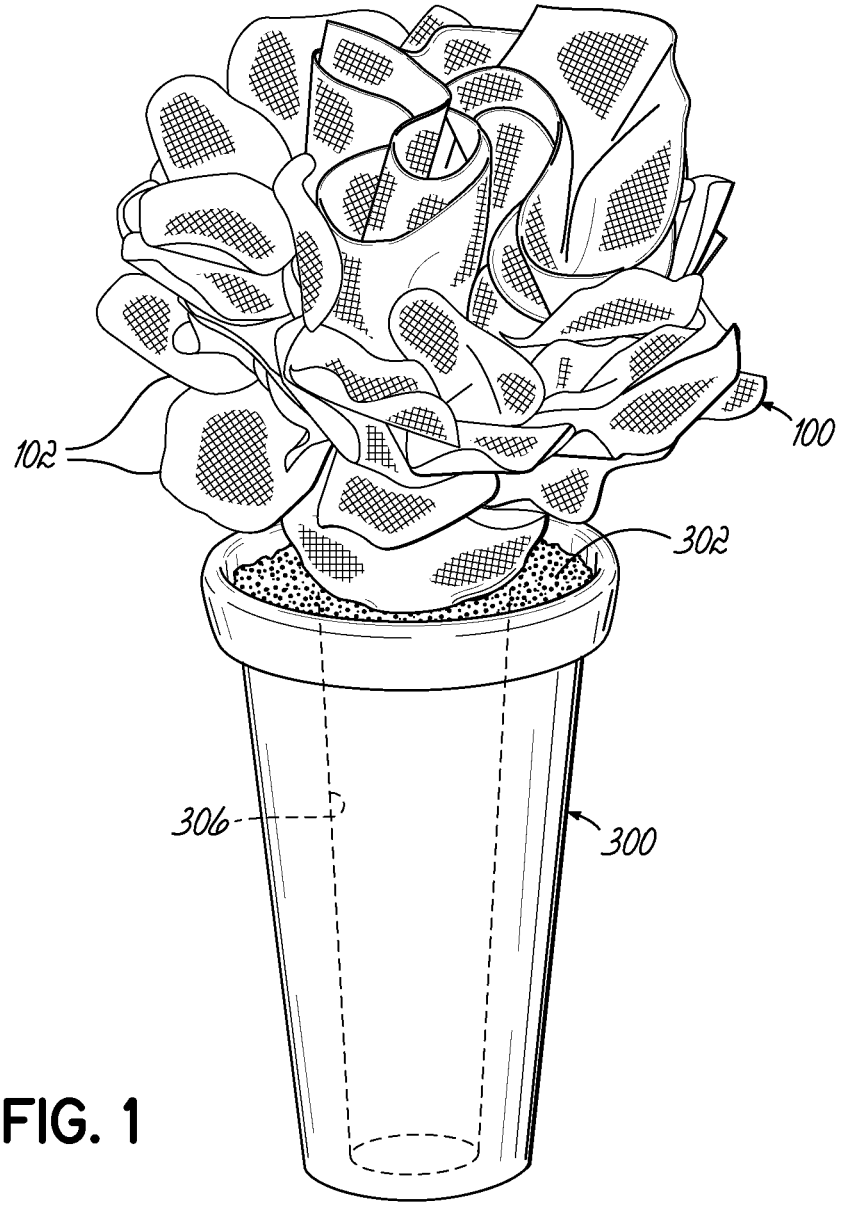
FIG. 1 is a perspective view of a convertible flower doll in flower form and a pot in accordance with one embodiment of the present invention.

FIG. 1 shows a simulated flower 100 sitting within a simulated pot 300. The folds of the flower 100 represent portions of cloth which may be colored in accordance with a flower type that the simulated flower 100 resembles, and may include visible features such as simulated petals 102.

The convertible doll 2 may be packaged and sold as the simulated flower 100 as shown in FIG. 1, with the packaging or other accompanying material conveying to the consumer that the flower 100 converts to a doll 2 and back to a flower 100 as desired. As one example, the toy may be packaged in a box appearing to be a wooden shipping crate appropriate for the shipping of a live plant. The toy may also be packaged in a burlap sack or other container appropriate for a flower in a period or locale associated with the character that the toy represents. Alternatively, the simulated flower 100 may sit in a retail store in a simulated garden area, from which the consumer selects it and places it in the simulated pot 300 in order to purchase and take it home. It will be understood that the dolls may be sold in conjunction with any presentation or extension of the "gardening" or "planting" metaphor which the retailer is willing to assemble and maintain, and that this metaphor may be carried out differently for different characters even within the same general theme presented by a line of these toys.

The doll 2 may be representative of a fictional character which is associated with the type of flower simulated by the flower 100. In this way, the particular identity of the doll 2 may be known based on the type of flower that is simulated, and a consumer familiar with the fictional characters may be able to determine the identity of the doll 2 even in flower form by recognizing the simulated flower 100. Further identification of the doll 2 to the consumer may or may not be necessary depending on the popularity and marketing of the associated characters.

Figure 2:
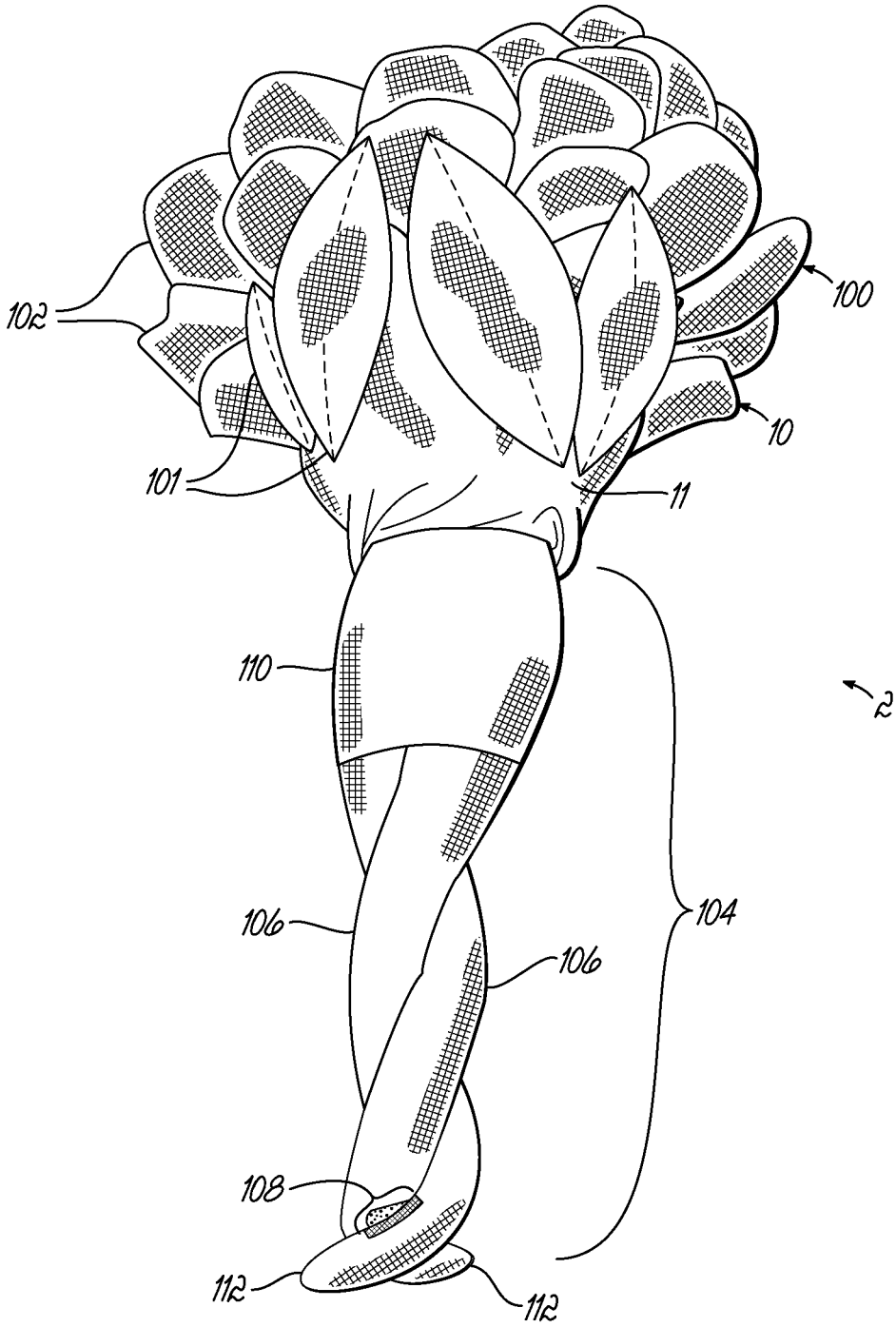
FIG. 2 shows the doll of FIG. 1 in flower form.
Figure 6A:
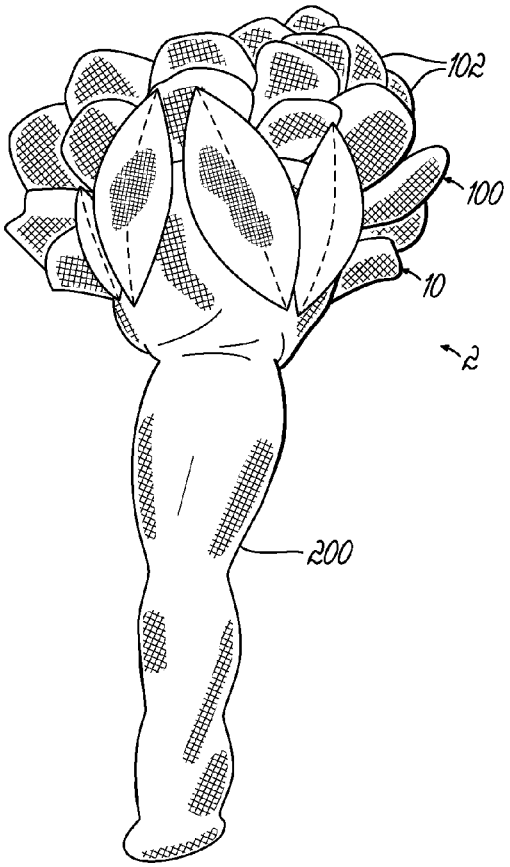
FIG. 6A shows another embodiment of the convertible flower doll with a removable sheath.
Figure 6B:
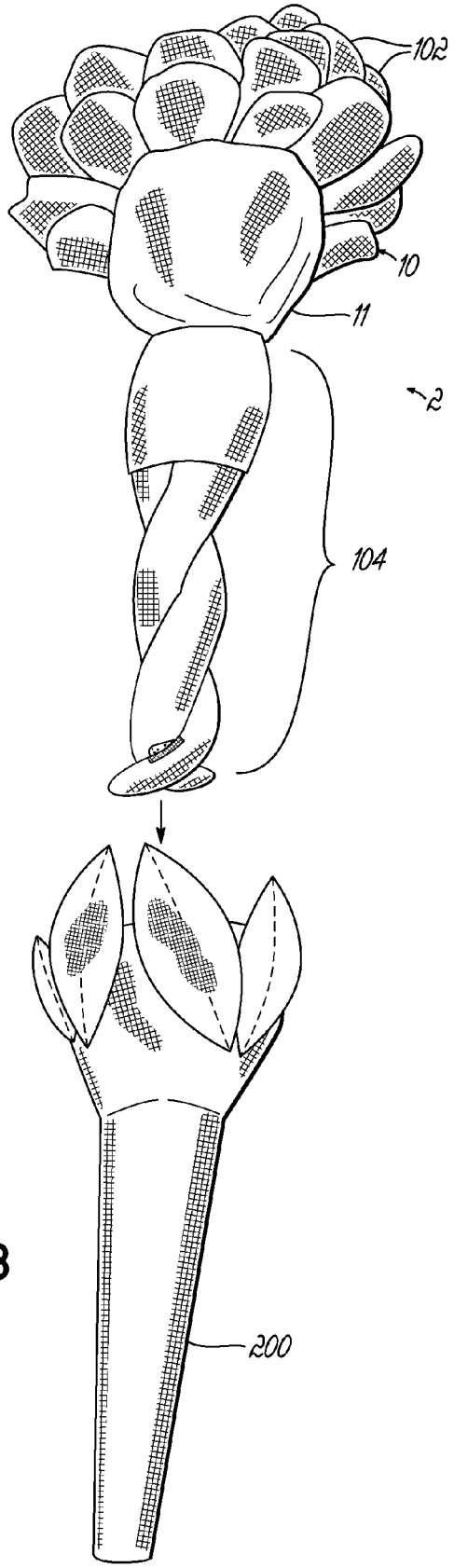
FIG. 6B shows an exploded view of the flower and sheath of FIG. 6A.

As shown in FIG. 2, the simulated flower 100 includes a lower portion 104 which may resemble a stem and which can be seen when the flower 100 is removed from the pot 300 as shown. The lower portion 104 may represent two legs 106 which can be engaged to simulate the stem as shown in FIG. 2, or disengaged to act as legs 106 of the doll 2 as further described below. To facilitate their engagement, each leg 106 may include a region 108 that adheres to the opposite region on contact, and preferably can be repeatedly engaged and disengaged. The regions 108 may involve a mechanical fastener such as a button or snap, areas of applied liquid adhesive, Velcro, or any other method known in the art. Alternatively, a separate fastener may be used, such as a sheath placed over the legs in order to properly present them as a flower stem, which is shown in FIGS. 6A-B and further described below. The legs 106 may be shaped to resemble plant features such as roots, and may include additional coloring, pigmentation, or embroidery appropriate for their designed appearance.

In order to be twisted as shown in FIG. 2, the legs 106 of the doll may be of a material flexible enough to twist and untwist as part of their regular movement. Plush legs would be an appropriate material for this function. The plush fabric could be of any type appropriate for the twisting and untwisting. Conventional natural and synthetic fabrics could be used, the fiber not needing significant elastic as the shape of the legs 106 themselves could reasonably deform to the extent shown without significantly deforming the shape of the fabric covering. The stuffing could include traditional doll material including fill cotton or a synthetic equivalent, or particulate matter such as sand or beans or a synthetic equivalent. Alternatively, a solid or hollow elastomeric material that can be twisted but also can return to its untwisted shape may also be used.

Although shown as twisted, legs 106 could be made of a relatively rigid material that is not intended to be twisted. For example, solid or jointed hard doll material could be used, such as plastic, porcelain, hard rubber, or any other material shaped as legs. While in flower form, the legs may be sheathed or otherwise concealed in order to present a more unified appearance. The legs may also attach together without twisting, and may even contain an interface which would allow them to "snap" or otherwise join together. In some embodiments, the two legs may appear to be a single piece when joined together by interlocking components and may still appear to be separate legs when separated.

As shown in FIG. 2, the area where the legs join may be covered by a modesty skirt 110 which can remain down even when the toy is in flower form. The modesty skirt 110 may be green to simulate a stem or may otherwise blend in to contribute to the simulation of the flower 100 when the toy is in flower form as shown in FIG. 2.

Figure 3:
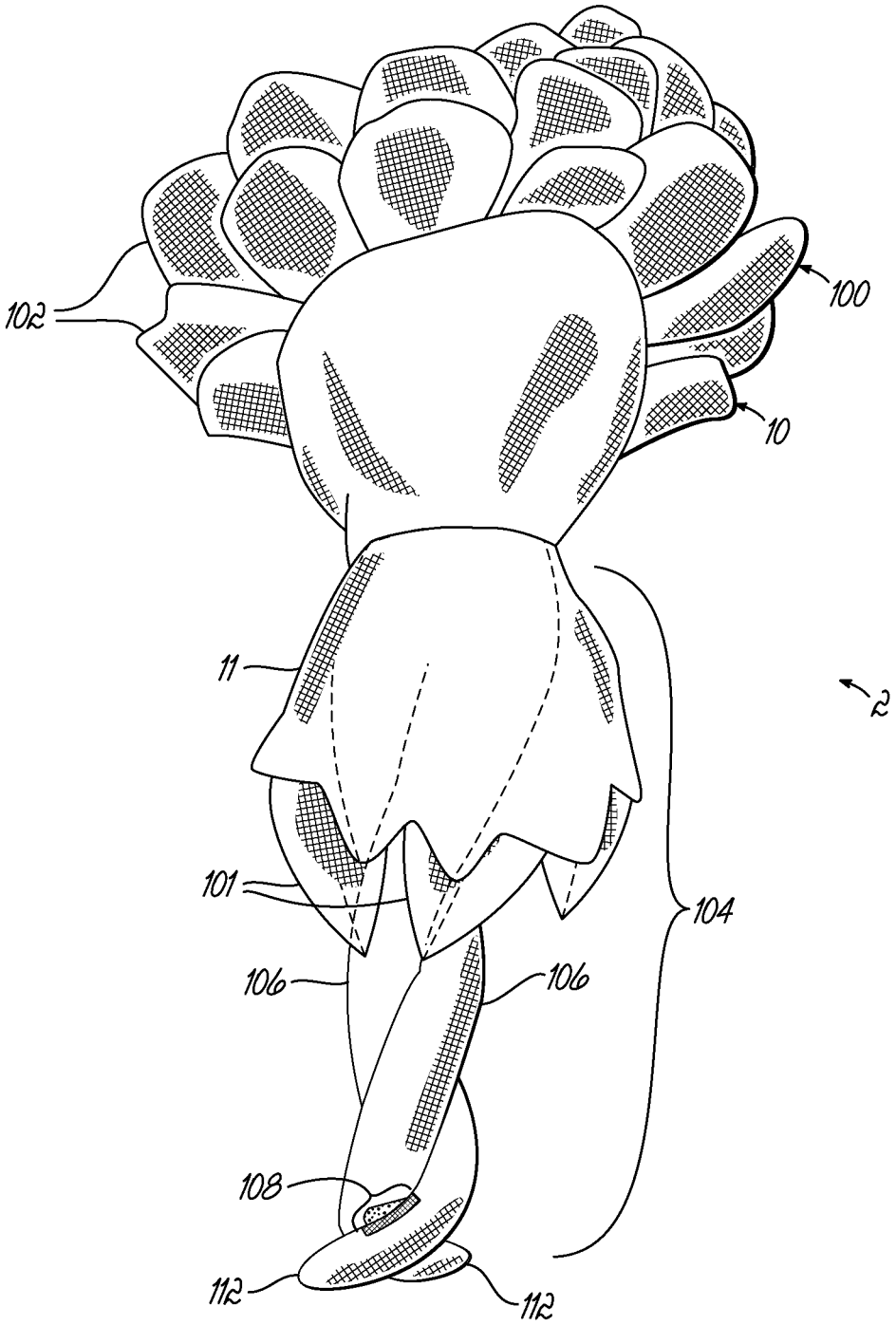
FIG. 3 shows the doll with one skirt layer lowered.
Figure 4:
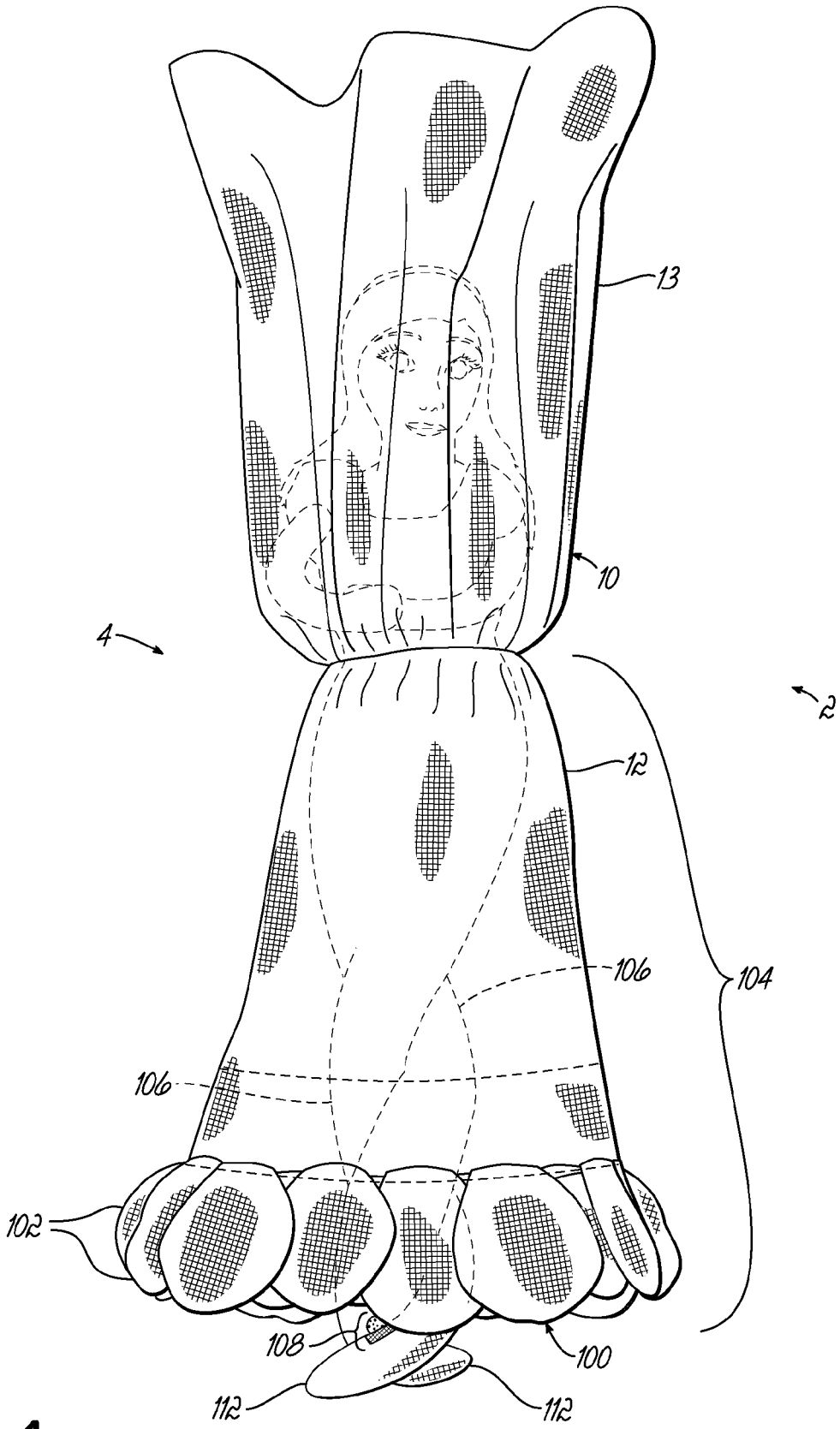
FIG. 4 shows the doll with a second skirt layer lowered.

The simulated flower 100 may be comprised of a skirt 10, which is shown in three layers 11, 12, and 13 in FIGS. 2-4. The lower layer 11 is shown lifted upward into a raised position in FIG. 2, holding the blossom of the flower 100 in place. FIG. 3 shows the lower layer 11 folded down around the lower portion 104. As shown, the lower layer 11 represents the sepal of the flower 100 with simulated leaves 104 affixed thereon.

The sepal layer 11 may be an elastic fabric which may be green in color. It forms the sepal of the simulated flower 100 as shown in FIG. 2. Because of the elastic nature of the fabric, the sepal layer 11 acts to bunch the layers of the skirt 10 together to create the appearance of the simulated flower 100 as shown. The sepal layer may be of any elastic fabric known in the art; for example, it may be formed of an artificial elastomeric material such as a spandex or other synthetic fabric. Natural elastic fabrics may be used.

The primary objective of the sepal layer 11 is to collect the layers of the skirt 10 to provide the structure necessary to display the simulated flower 100. Rather than, or in addition to, the use of an elastic fabric, the structural requirements of the sepal layer 11 may be met by the use of an elastic band around the upper edge 16. Additional structural elements, for example longitudinal ribs or other features, may instead be used to enclose the skirt layers 12, 13 and simulate the appearance of the flower. Although shown as an integral feature of the dress 4, one of ordinary skill will understand that the structural elements capable of enclosing the skirt layers 12, 13 to similar the appearance of a flow may be partially or wholly separate from the dress 4 or doll 2, as shown in FIGS. 6A-B and discussed further below.

It should be understood that the sepal layer 11 may be a separate piece which may or may not be visible as part of the doll's dress 4. For example, the structural layer may be long enough to be visible below any other dress layer, and so may be of a color appropriate to be seen as part of the doll's dress. Whatever bottom layers of the dress provide the structure when the toy is in flower form as shown in FIG. 2 may be suggestive of a sepal or other flower parts only on one side, and may instead appear different when reversed to be part of the dress 4. For example, the underlying structural layers of the doll's dress may be green on the side visible when in flower form but may be the same color as the rest of the doll's dress 4 on the other side. Leaves or other elements may further be used as part of the structure or provided as additional simulated parts to the flower 100, such as the leaves 101 shown in FIGS. 2-3.

The middle layer 12 is shown lifted upward into a raised position in FIG. 3. FIG. 4 shows the middle layer 12 folded down around the lower portion 104 and the lower layer 11. The middle layer 12 may be made of an opaque material, for example a color suggestive of the flower type simulated by the flower 100 and of a material appropriate to a doll's dress, and may include decorative elements appropriate for the skirt of a doll's dress. As mentioned, the middle layer 12 may be attached by any appropriate means to the lower layer 11 or upper layer 13, and may be of a length appropriate to be viewed in conjunction with those layers as part of a dress skirt 10 when the doll 2 is in its girl form.

Figure 5:
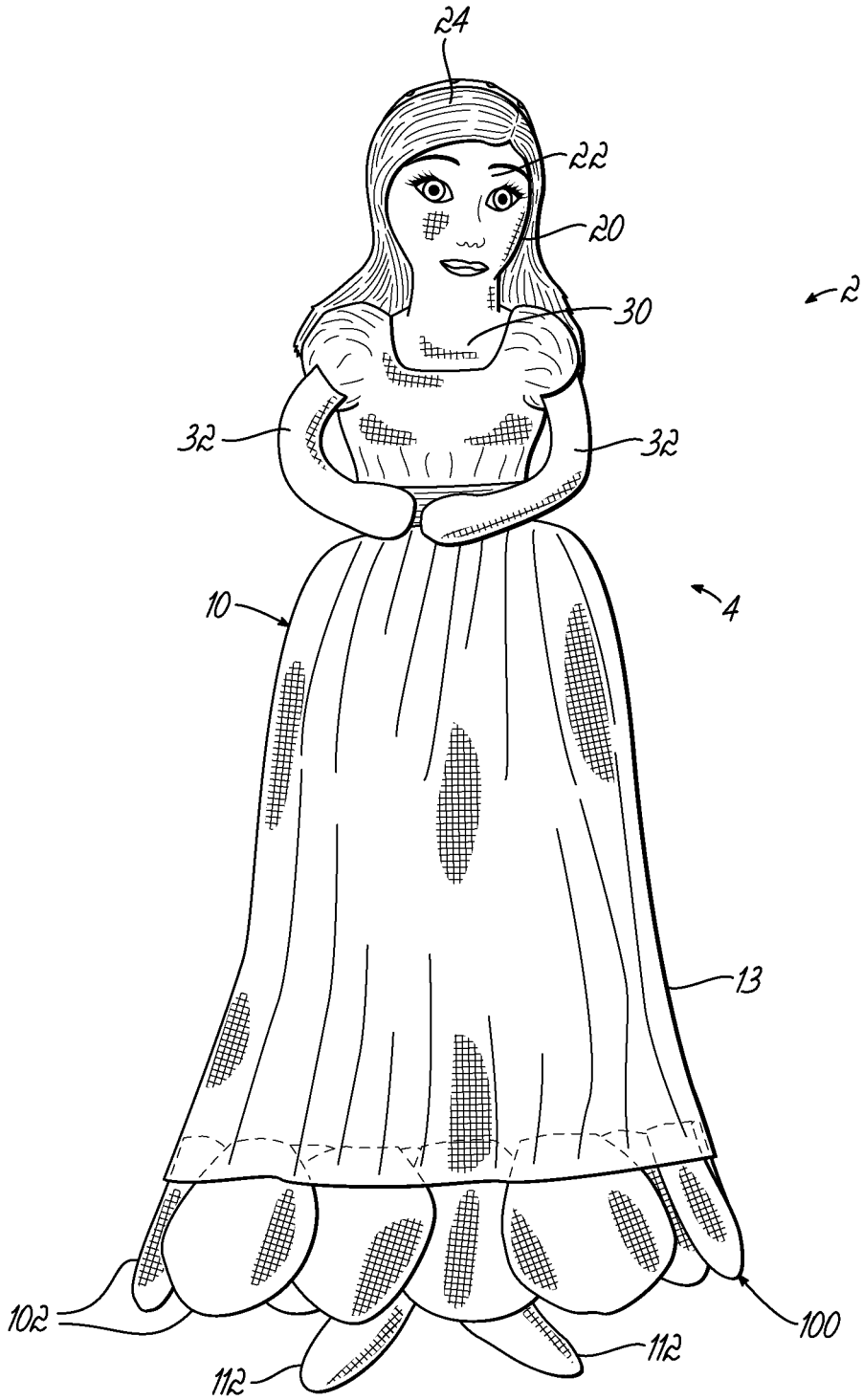
FIG. 5 shows the doll in girl form with all skirt layers lowered.

The middle layer 12 of the skirt 10 may be pleated fabric sewn according to a conventional dress pattern as known in the art. As such, the layer 12 may correspond to fabric associated with the upper part of the doll's dress 4 as shown in FIG. 5 and discussed further below. The dress layers 11-13 may be separate fabric pieces that are sewn or otherwise attached to the upper part of the dress 4, or one or more of the layers may be of one fabric piece with the upper part of the dress 4. Multiple layers of the skirt may correspond to multiple layers of the upper dress.

The middle layer 12 is shown acting as the base layer of the doll's dress 4. It includes a set of petals 102 which may be sewn or otherwise attached to the fabric of the middle layer 12, acting as features of the dress 4 when lowered and as part of the simulated blossom of the flower 100 when raised and contained by a structural layer such as the lower layer 11. Some or all of the features of this middle layer 12 may be embodied in multiple attached skirt layers, or in one or more layers that are not attached. Other flower or dress features may be included by means of embroidery, dye, attachment of additional pieces, or any other means known in the art.

The upper layer 13 is shown lifted upward into a raised position in FIG. 4. FIG. 5 shows the upper layer 13 folded down around the lower portion 104 and the other layers of the skirt 10. The upper layer 13 may be an embroidered layer of opaque material appropriate to hide any stitching used in the middle layer 12 in order to attach the petals 102. Alternatively, the upper layer 13 may be a thin, see-through material appropriate for the decorative outer layer of the skirts of a doll's dress. Light, transparent fabrics such as gauze or openwork fabrics such as lace could be used. As the number of layers of the skirt is not limited to three, both an opaque underlayer and a transparent overlayer may be used in place of the layer 13, or any other configuration appropriate to the dress design as known to one skilled in the art.

Each of the three layers 11, 12, 13 may be of different length such that each lower layer can be at least partially seen under each outer layer when the skirt 10 is folded down as part of the dress 4. This is one method by which the layers may correctly bunch into a flower when reversed. Alternatively, only one or more outer layers of the skirt may be mainly visible, with underneath layers, not immediately visible from casual surface inspection of the doll in the dress, forming petticoats for the dress. The petticoats may be a soft weave, silk or a soft synthetic for example, and may be shaped and colored particularly to suit the appearance of a simulated flower when raised. One or more of the petticoat layers may include petals, similar to those shown on the lower layer 11 in the figures. Because the appearance of the petticoats may be primarily tailored to the flower form and will emerge from below the skirt layers in girl form to outside the skirt layers in flower form, petticoat layers may serve the simulated flower appearance of the doll particularly well.

Although shown herein as being separately reversible, the skirt layers may be attached along their length or at end points in order to control the shape when both raised and lowered. In one example, layers may be attached along one or more side seams. Alternatively, adhesive or some other method of attachment may be used. A pattern of stitching may also provide an attachment between layers while also contributing to the design of the skirt; for example edge stitching might be used, or intermediate stitching patterns between adjacent layers. If so attached, the skirt layers may be constrained to only be raised or lowered as a unit; for example, it may not be possible to have some skirt layers around the doll's upper torso while other layers cover the doll's lower portion as shown in FIGS. 3 and 4.

In some embodiments, whatever layer or layers serve as the structural layer or layers, such as the sepal layer 11, may be presented as an underdress or slip for the figure represented by the doll. Giving the bottom layer a formal role as a part of a doll's clothing may further work in favor of the doll being seen as a person, as well as allowing the user to more easily accept the multiple layers of the doll's outfit as an appropriate part of the toy.

It should be understood that the inventive features explained herein with respect to the doll and dress could be usable with many variations in dress construction as known in the art. For example, a variety of natural and synthetic fabrics including polyester, viscose, silk, cotton, or Rayon could be used for the dress fabric, and different materials may be used for different components of the dress. Blended fabrics may also be used. One of ordinary skill will understand that the selection of dress fabrics may depend on cost as well as on the visual and tactile impact of different fabrics for different purposes for a simulated dress and flower.

A variety of colors may be used which compliment the identity of the simulated flower and/or the identity of the represented character, and multiple colors may be used where appropriate. Pigments or dyes may be used to represent ornamentation or design. Embroidered ornamentation may be included, and additional components may be removably or non-removably attached to any portion of the dress as known in the art. The dress may be permanently attached to the doll through stitching, adhesive, or even material that is constructed integrally with part of the doll's surface. The dress may be removably attached to the doll through the use of any means known in the art. Standard dress fastenings such as buttons, snaps, zippers, Velcro, or ties may be used on the dress; fastenings may also be included on the doll itself and used to attach the dress as known in the art.

Sleeves, collars, and other components of the dress may be removable, and different designs of removable dress features may be interchangeable for a variety of purposes. Any dress components may include the same or different colors, materials, design, and ornamentation as known in the art.

FIG. 5 shows a doll 2 with a dress 4 including the skirt 10 in layers as described above. References herein to the girl, princess, or figure form of the doll are in reference to the doll with the skirt 10 fully lowered as shown in FIG. 5. Although shown as a figure of a girl, other characters may be represented by the doll, including male and nonhuman characters. One of ordinary skill will understand that the particulars may greatly vary as further discussed below. Concern is paid both to the easy conversion of the doll and its appealing appearance.

As explained above with respect to the legs 106, the doll 2 may be a full body doll representing any sort of figure, and may be of any construction appropriate for that purpose. For instance, the doll may be a plush doll as shown in FIGS. 1-5. Alternatively, the doll may be a fashion doll, porcelain doll, or other type of flexible or rigid figure. Hard plastic, elastomeric plastic, rubber-based or gum-based materials may be used to generate the doll figure in whole or in part through the use of molds and other shaping processes. Plush dolls may be made using a variety of surface fabrics and stuffed with a variety of materials. The doll may exhibit more detail in the face and limbs, or may be primarily identified by features of the dress. Features of the doll, such as the doll's hair, may be removable or may be integrally attached.

The doll's head 20 may be integral with the torso 30 or may be removable by any means known in the art, for example by snap-fitting or screw fastening a head into a receptive torso. The head 20 may be a hollow or solid plastic or may be a plush head. A rubber-based or gum-based material may be used for a part of the surface or interior of the doll head. The head 20 may be posable and may swivel relative to the torso 30.

The doll's head 20 may include a face 22 with embroidered features as shown. Alternatively, the face features may be formed by means of pigmentation or may be sculpted my means of a material receptive to shaping. For example, molded plastic, ceramic, or porcelain may be used to simulate a face with three-dimensional features. The face 22 may include materials not otherwise found in the head 20 of the doll 2. The face 22 may include movable features such as eyelids. Glass eyes or gem-shaped eyes may be included on the face 22.

Certain features of the face 22 may be removable and interchangeable by the user as known in the art. The face 22 may be made of a material which is receptive to erasable pigmentation, and the user may be invited to draw on facial features or augment existing features (such as with simulated make-up). Stickers and/or rub-on "tattoos" may also be included for use in the face 22 and/or elsewhere on the doll 2.

The doll's hair 24 may be natural or synthetic fiber, including real hair (human or animal), recycled fiber, or plastic. The hair 24 may be permanently attached by means of glue, stitching, or any means as known in the art. Alternatively, the hair 24 may be removable and held to the head 20 by means of Velcro, snaps, releasable adhesive, elastic, or by a shape that fits closely to the head 20. Multiple wigs with different hair styles, lengths, colors, and/or accessories may be available to interchange for the doll. The doll's hair 24 may be a natural or artificial hair color, and may match either the figure represented by the doll 2 or may correspond to the identity of the simulated flower of a dress. The hair's texture and style may also correspond to the doll's identity. Like each other aspect of the doll 2, the hair 24 may be decorated with a variety of accessories. Ribbons, a hat, a tiara, pins, flowers or flower petals, insects, weeds or vines, or other hair accessories may be included. Hair accessories may be permanently affixed to the hair 24 or may be removable.

The torso 30 may be a soft or hard piece and may be colored as skin, as a flower (with colors of the bloom and/or stem), or as clothing. For example, the surface of the torso 30 may include embroidery, pigmentation, or attached accessories to simulate undergarments or a bathing suit. If any part of the torso 30 is colored as skin, anatomical features can be included or excluded in accordance with the nature of the character, the selection of the designer, and the target age of the doll, as well as in accordance with manufacturing and cost considerations.

Arms 32 may be removable via screw-on or snap connections as known to one in the art, or may be more permanently attached to the torso 30 or formed integral with the torso 30. The arms 32 may be colored and shaped to simulate sleeves or the bare arms of the figure depicted by the toy. The arms 32 may be plush or may be another material, and may include the ability to grasp and hold objects. Alternatively, accessories may be included that temporarily or permanently attach to the arms 32. The arms 32 may fold to a set position when the toy is in flower form. The arms 32 may also have a limited range of positions within which they will not interfere with the conversion to flower form.

Although the majority of the doll's legs 106 may be covered by the dress 4 when in princess form as shown in FIG. 5, the feet 112 may be visible. Each foot 112 may have features associated with feet, for example embroidered or pigmented designs representing toes. The feet may also be molded or otherwise shaped to include these features. Instead of or in addition to simulated feet, the feet 112 may also have features representing footwear such as shoes or sandals. Shoes may be embroidered onto the feet or the feet may be molded or otherwise shaped to resemble shoes. Footwear may also be included as a removable accessory; in some embodiments the feet 112 may themselves be removable and may be replaced by feet including footwear.

The dress 4 may be fully removable, and it may be possible to replace the dress 4 with another dress including the same ability to convert the doll 2 to a flower, or any conventional dress appropriate to the doll's full-body size. Alternatively, the dress 4 or some portion of it may be integral with the doll 2 and not readily removable. For example, the dress 4 may be sewn or adhered to the doll 2. In another embodiment, the top part of the dress 4 may be sewn or adhered to the doll 2, but the skirt 10 may be removably attached to the doll 2 or the top part of the dress 4 and may be removable.

Although shown as a dress 4, one of ordinary skill in the art will recognize that other garments may include the features described herein, and that the inventive features disclosed herein are not limited to applying only to a dress as known in the art. Any garment or other covering appropriate to the figure represented by the doll may include the features of the convertible flower toy discussed herein.

Although jewelry, head ornaments, and footwear are mentioned above with respect to specific parts, any part of the doll 2 is receptive to accessories appropriate to the character that the toy depicts. These may include clothing-type or tool-type accessories, vehicles, secondary characters or pets, scenery, or even additional parts of the character (wings, a tail, antennae, etc.) Some or all of the accessories may be permanently affixed to the doll 2 and/or the dress 4; the accessories may also be removable and may be exchanged to provide different options to the user.

FIG. 6 shows an alternate version of the structural layer which is separate from the dress 4 and removable. Here, a sheath 200 is placed over the legs 106 in order to create the appearance of a stem for the flower 100. The sheath 200 may have all of the features previously explained for the lowest layer 11 of the skirt 10, but may be removed from the doll 2 as part of the conversion process of the toy from a simulated flower to a figure representing a girl or other character. A toy that includes the sheath 200 may have legs that are colored and shaped as appropriate for the figure represented by the doll 2, including skin and outfit colors appropriate for the dress 4. Because the legs are sheathed when the toy is in its flower form, they need not conform to the color and shape of the simulated flower 100. The sheath 200 may include Velcro, ties, or any other method of securing it to the toy. It may be made of a stiff material appropriate to allow it to act as the structural layer for bunching the skirt 10 into the blossom of the flower 100. It may include an elastic band, longitudinal ribs, or other features useful for contributing to the support and shape of the flower 100. The sheath 200 may be made of a vinyl or other natural or synthetic fiber, or may be made of a soft or hard plastic or rubber-based or gum-based material resembling roots or a stem. The sheath 200 may have designs or shapes such as leaves or roots which contribute to its appearance as part of the simulated flower 100.

Figure 7:
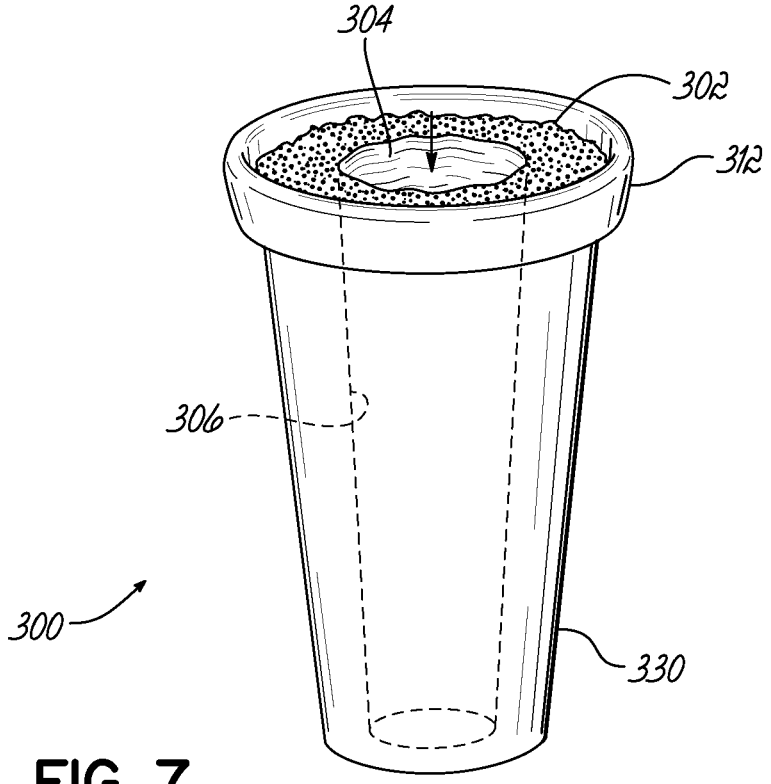
FIG. 7 shows the pot of FIG. 1.

FIG. 7 shows the pot 300, which may be weighted in order to remain upright when holding the simulated flower 100. In the exterior of the pot is a simulated soil surface 302, within which is an opening 304 into a recess 306. The recess 306 may be properly sized and shaped for receiving the lower portion 104 of the simulated flower 100, as shown in FIG. 1. The pot 300 may be of any shape appropriate for receiving the simulated flower 100. In other embodiments, alternate containers may receive the flower 100, such as a vase, a hanging planter, or even a simulated outdoor scene such as a garden or forest. Some containers may include multiple recesses in order to accommodate multiple simulated flowers 100 as shown. A container may also contain some ability to interact with the toy in its girl form as shown in FIG. 5; for example, the container may be sized and shaped to act as a piece of clothing or furniture for a transformed figure.

Figure 8:
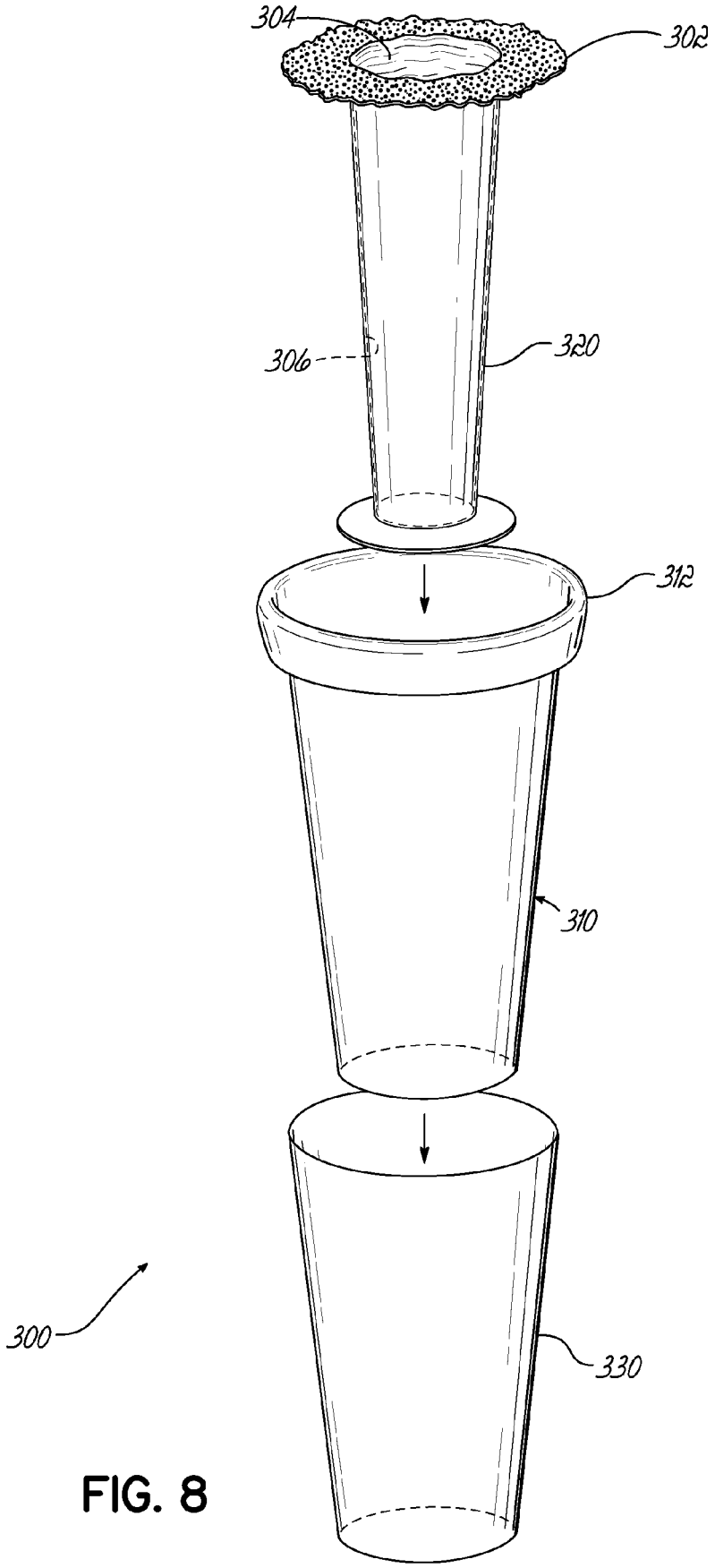
FIG. 8 shows an exploded view of the three pieces of the pot of FIG. 7 according to an embodiment of the present invention.

As shown in FIG. 8, the pot 300 may be formed of multiple pot pieces, including a main body 310, an insert 320, and an outer cup 330. As shown, the recess 306 may reside within the insert 320, and the upper surface 302 with the opening 304 therein may also be part of the insert 320. The insert 320 may also include a base 308 which fits into the bottom of the interior of the main body 310.

The main body 310 in turn fits into the outer cup 330, which may be decorated with designs and illustrations associated with the flower or figure represented by the toy. The main body 310 may include a lip 312, and the outer cup 330 may fit around the main body 310 under the lip 312. The outer cup 330 may represent a replaceable accessory which may also double as a drinking cup. Outer cups of different colors and designs may be interchangeable around the main body 310 to form the pot 300.

The pot 300 may be formed of plastic, wood, metal, or any other material and may be constructed and assembled separately from the doll 2 and dress 4. In one embodiment, some or all of the pieces 310, 320, 330 of the pot 300 may be molded. If molded or formed as multiple pieces, any epoxy or other adhesive may be used to assemble the pieces. Alternatively, the pieces may include screws or other fasteners, which may be integral with or separate from the main pieces of the pot 300. The pieces may snap-fit or be assembled by means of heat treatment. All three pieces 310, 320, 330 may be shaped for easy disassembly and replacement of any piece. One of ordinary skill in the art will recognize design and manufacturing considerations in order to reduce the costs of production for the pot 300 and/or the doll 2. The outer cup 330 may be made of a material, such as paper or hard foam, appropriate for use in a drinking cup. The outer cup 330 may be made of a readily disposable material even if the main body 310 and/or the insert 320 are made of a different material.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. A convertible flower doll, comprising:
- a body comprising an upper body including a head and a pair of arms and a lower body including a pair of legs;
- a reversible skirt movable between a raised position and a lowered position such that the skirt resembles part of a garment in the lowered position and a simulated blossom of a flower in the raised position, with the simulated blossom of the flower being located proximate the upper body of the doll;
- wherein the skirt in the raised position conceals the upper body of the doll; and
- wherein the upper body of the doll is visible when the skirt is in the lowered position.

2. The doll of claim 1, wherein the skirt comprises features resembling flower petals that are visible as part of the flower when the skirt is in the raised position and visible as part of the garment when the skirt is in the lowered position.

3. The doll of claim 1, wherein the skirt comprises elastic that maintains the shape of the simulated blossom of the flower when the skirt is in the raised position.

4. The doll of claim 3, wherein the skirt comprises an upper layer and a lower layer, and wherein the lower layer surrounds the upper layer and comprises elastic to maintain the shape of the simulated blossom of the flower when the skirt is in the raised position.

5. The doll of claim 1, wherein the pair of legs can be positioned to resemble a flower stem when the skirt is in the raised position.

6. The doll of claim 1, wherein the pair of legs can be attached together and twisted to resemble a flower stem.

7. The doll of claim 1, further comprising:
- a container having an opening sized to receive the lower body of the doll when the reversible skirt is positioned to resemble a flower.

8. The doll of claim 7, wherein the container resembles a flower pot, the container further comprising a surface adjacent the opening sized and colored to resemble a planting medium for a flower.

9. A convertible flower doll, comprising:
- a body comprising an upper body including a head and a pair of arms and a lower body including a pair of legs;
- a reversible skirt movable between a raised position and a lowered position such that the skirt resembles part of a garment in the lowered position and a simulated blossom of a flower in the raised position, with the simulated blossom of the flower being located proximate the upper body of the doll; and
- a sheath positioned to enclose the skirt to maintain the shape of the simulated blossom of the flower when the skirt is in the raised position;
- wherein the skirt in the raised position conceals the upper body of the doll; and
- wherein the upper body of the doll is visible when the skirt is in the lowered position.

10. The doll of claim 9, wherein the skirt comprises features resembling flower petals that are visible as part of the flower when the skirt is in the raised position and visible as part of the garment when the skirt is in the lowered position.

11. The doll of claim 9, wherein the sheath is positioned to conceal the lower body of the doll and resemble a part of the flower when the skirt is in the upper position.

12. The doll of claim 11, wherein the sheath is a separate component from the body and the skirt such that the sheath can be removed when the skirt is in the lowered position.

13. The doll of claim 9, wherein the pair of legs can be positioned to resemble a flower stem when the skirt is in the raised position.

14. The doll of claim 9, wherein the pair of legs can be attached together and twisted to resemble a flower stem.

* * * * *